US010221046B2

(12) United States Patent
Hu et al.

(10) Patent No.: US 10,221,046 B2
(45) Date of Patent: Mar. 5, 2019

(54) SYSTEM OF MONITORING HANDRAIL FOR A PASSENGER CONVEYER DEVICE, A PASSENGER CONVEYER DEVICE AND MONITORING METHOD THEREOF

(71) Applicant: Otis Elevator Company, Farmington, CT (US)

(72) Inventors: ZhaoXia Hu, Zhejiang (CN); Wilfrid Fuchs, Langenzersdorf (AT); Alois Senger, Gresten (AT); Hui Fang, Shanghai (CN); Zhen Jia, Shanghai (CN); Jianwei Zhao, Shanghai (CN); Qiang Li, Shanghai (CN); Anna Su, Shanghai (CN); Alan Matthew Finn, Hebron, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/975,825

(22) Filed: May 10, 2018

(65) Prior Publication Data

US 2018/0257912 A1 Sep. 13, 2018

Related U.S. Application Data

(63) Continuation of application No. 15/663,452, filed on Jul. 28, 2017.

(30) Foreign Application Priority Data

Jul. 29, 2016 (CN) ..... 2016 1 0610015

(51) Int. Cl.

| | |
|---|---|
| ***B66B 23/20*** | (2006.01) |
| ***B66B 21/02*** | (2006.01) |
| ***B66B 25/00*** | (2006.01) |

(52) U.S. Cl.
CPC ..... *B66B 23/20* (2013.01); *B66B 21/02* (2013.01); *B66B 25/003* (2013.01); *B66B 25/006* (2013.01)

(58) Field of Classification Search
CPC ..... B66B 21/02; B66B 25/003; B66B 25/006
(Continued)

(56) References Cited

U.S. PATENT DOCUMENTS 5,072,820 A * 12/1991 Steffen ..... B66B 29/005 198/323
5,083,653 A 1/1992 Sakata et al.
(Continued)

FOREIGN PATENT DOCUMENTS

CN 201321333 Y 10/2009
CN 102107816 A 6/2011
(Continued)

OTHER PUBLICATIONS

EP Communication; Extended European Search Report; Application No. 17184138.0-1017; dated Jan. 8, 2018, pp. 1-10.
(Continued)

*Primary Examiner* — Douglas A Hess
(74) *Attorney, Agent, or Firm* — Cantor Colburn LLP

(57) ABSTRACT

A moving handrail monitoring system includes a sensor configured to sense at least part of a moving handrail of the passenger conveying device to acquire a data frame; a processing device configured to analyze and process the data frame to monitor whether a tension degree of the moving handrail is in a normal state, wherein the processing device is configured to include: a target object recognition module configured to recognize, based on a sensed movement and/or position and/or color and/or shape, a moving handrail portion that serves as a target object from the data frame; an object feature extraction module configured to extract a
(Continued)

tension degree feature of the moving handrail portion; and a judgment module configured to compare the extracted tension degree feature with a system preset interval, and judge whether a current tension degree of the moving handrail is normal.

5 Claims, 5 Drawing Sheets

(58) Field of Classification Search
USPC ..... 198/323, 335, 336, 337
See application file for complete search history.

(56) References Cited

U.S. PATENT DOCUMENTS 5,092,446 A * 3/1992 Sullivan, Jr. ..... B66B 29/04 198/323
5,099,977 A 3/1992 Hirose et al.
5,188,209 A 2/1993 Johnson et al.
5,245,315 A 9/1993 Johnson et al.
5,544,730 A * 8/1996 Adrian ..... B66B 23/20 198/336
5,645,156 A 7/1997 Zaharia et al.
6,015,038 A 1/2000 Stoxen et al.
6,112,166 A * 8/2000 Joosten ..... B66B 27/00 198/323
6,460,679 B1 10/2002 Stuffel et al.
6,752,255 B2 6/2004 Lefeuvre
6,994,204 B2 2/2006 Buescher et al.
7,404,477 B1 * 7/2008 Toennisson ..... B66B 29/005 198/323
8,061,215 B2 * 11/2011 Caunce ..... G01L 5/102 73/826
8,205,735 B2 6/2012 Behan et al.
2003/0136635 A1 * 7/2003 Lauch
2018/0029833 A1 2/2018 Hu et al.

FOREIGN PATENT DOCUMENTS

CN 103112774 A 5/2013
DE 10018410 A1 10/2001
EP 0960847 A1 12/1999
JP H07137975 A 5/1995
JP 2005126175 A 5/2005
JP 2010265057 A 11/2010
JP 2011136789 A 7/2011
JP 2012218868 A 11/2012

OTHER PUBLICATIONS

Kone Safety Features for Escalators and Autowalks—Fact Sheet; Internet; URL: http://cdn.kone.com/www.kone.my/Images/brochure-escalators-and-autowalks-safety-factsheet.pdf; 2012; 2 pgs.

* cited by examiner

SYSTEM OF MONITORING HANDRAIL FOR A PASSENGER CONVEYER DEVICE, A PASSENGER CONVEYER DEVICE AND MONITORING METHOD THEREOF

CROSS-REFERENCE TO RELATED APPLICATIONS

This application is a continuation of U.S. application Ser. No. 15/663,452, filed Jul. 28, 2017, which claims priority to Chinese Patent Application No. 201610610015.9, filed Jul. 29, 2016, and all the benefits accruing therefrom under 35 U.S.C. § 119, the contents of which in their entirety are herein incorporated by reference.

FIELD OF THE INVENTION

The present invention relates to the field of passenger conveying devices, and in particular, the present invention relates to a moving handrail monitoring system for a passenger conveying device and a monitoring method thereof.

BACKGROUND

As a tool for helping passengers to walk between floors or reducing a walking distance of passengers, a passenger conveying device is very common in daily life. As an example, escalators generally used between floors of commercial buildings and moving walks generally used in large airports are especially common.

To make it convenient for passengers to take such a type of tool or keep balance, automatic handrails that operate synchronously with the passenger conveying device are provided on two sides of the passenger conveying device for passengers to hold. Many factors are taken into consideration in design of the automatic handrail. For example, the automatic handrail should not be over-tense; otherwise, the automatic handrail strap will be abraded more quickly. On the other hand, the automatic handrail should also not be over-loose; otherwise, the running speed of the automatic handrail strap will be faster than or slower than the speed of steps, which may cause a standing passenger to loose balance or even fall over. Therefore, it is necessary to set the automatic handrail strap within a proper tension degree interval.

In addition, the passenger conveying device is an apparatus having a relatively long service cycle. Therefore, in the service life thereof, it is also necessary to keep monitoring the tension degree of the automatic handrail all the time to detect in time the problem of being loose or too tense caused by various situations during running of the apparatus and to make timely control.

SUMMARY OF THE INVENTION

An objective of the present invention is to provide a moving handrail monitoring system for a passenger conveying device.

Another objective of the present invention is to provide a passenger conveying device.

A further objective of the present invention is to provide a moving handrail monitoring method of a passenger conveying device.

According to an aspect of the present invention, a moving handrail monitoring system for a passenger conveying device is provided, which includes: an imaging sensor and/or a depth sensing sensor configured to sense at least part of a moving handrail of the passenger conveying device to acquire a data frame; a processing device configured to analyze and process the data frame to monitor whether a tension degree of the moving handrail is in a normal state, wherein the processing device is configured to include: a target object recognition module configured to recognize, based on a sensed movement and/or position and/or color and/or shape, a moving handrail portion that serves as a target object from the data frame; an object feature extraction module configured to extract a tension degree feature of the moving handrail portion that serves as the target object; and a judgment module configured to compare the extracted tension degree feature with a system preset interval, and judge whether a current tension degree of the moving handrail is normal.

According to another aspect of the present invention, a passenger conveying device is further provided, which includes the moving handrail monitoring system described above and a moving handrail, wherein the imaging sensor and/or the depth sensing sensor are/is arranged inside the passenger conveying device.

According to a further aspect of the present invention, a moving handrail monitoring method of a passenger conveying device is provided, which includes: S1100, a data frame acquisition step: acquiring a packet data frame based on an imaging sensor and/or a depth sensing sensor that sense/senses at least part of a moving handrail of the passenger conveying device; S1200, a target object recognition step: recognizing, based on a sensed movement and/or position and/or color and/or shape, a moving handrail portion that serves as a target object from the data frame; S1300, an object feature extraction step: extracting a tension degree feature of the moving handrail portion that serves as the target object; and S1400, a judgment step: comparing the extracted tension degree feature with a system preset interval and judging whether a current tension degree of the moving handrail is normal.

According to a still another aspect of the present invention, a moving handrail monitoring system for a passenger conveying device is further provided, which includes: an imaging sensor and/or a depth sensing sensor configured to sense at least part of a moving handrail of the passenger conveying device to acquire a data frame; a processing device configured to analyze and process the data frame to monitor whether a tension degree of the moving handrail is in a normal state, wherein, the processing device is configured to include: a target object recognition module configured to recognize, based on a sensed movement and/or position and/or color and/or shape, a moving handrail portion that serves as a target object from the data frame; a reference background that includes a normal zone and an abnormal zone; and a judgment module configured to judge whether a current tension degree of the moving handrail is normal based on whether the moving handrail portion that serves as the target object falls in the normal zone and/or abnormal zone of the reference background.

According to a yet another aspect of the present invention, a passenger conveying device is further provided, which includes the moving handrail monitoring system described above and a moving handrail, wherein the imaging sensor and/or the depth sensing sensor are/is arranged inside the passenger conveying device.

According to a further aspect of the present invention, a moving handrail monitoring method of a passenger conveying device is further provided, which includes: S2100, a data frame acquisition step: acquiring a data frame based on an imaging sensor and/or a depth sensing sensor that sense/ senses at least part of a moving handrail of the passenger conveying device; S2200, a target object recognition step: recognizing, based on a sensed movement and/or position and/or color and/or shape, a moving handrail portion that serves as a target object from the data frame; S2300, a judgment step: judging whether a current tension degree of the moving handrail is normal based on whether the moving handrail portion that serves as the target object falls in a normal zone and/or an abnormal zone of a reference background.

DETAILED DESCRIPTION

Figure 1:
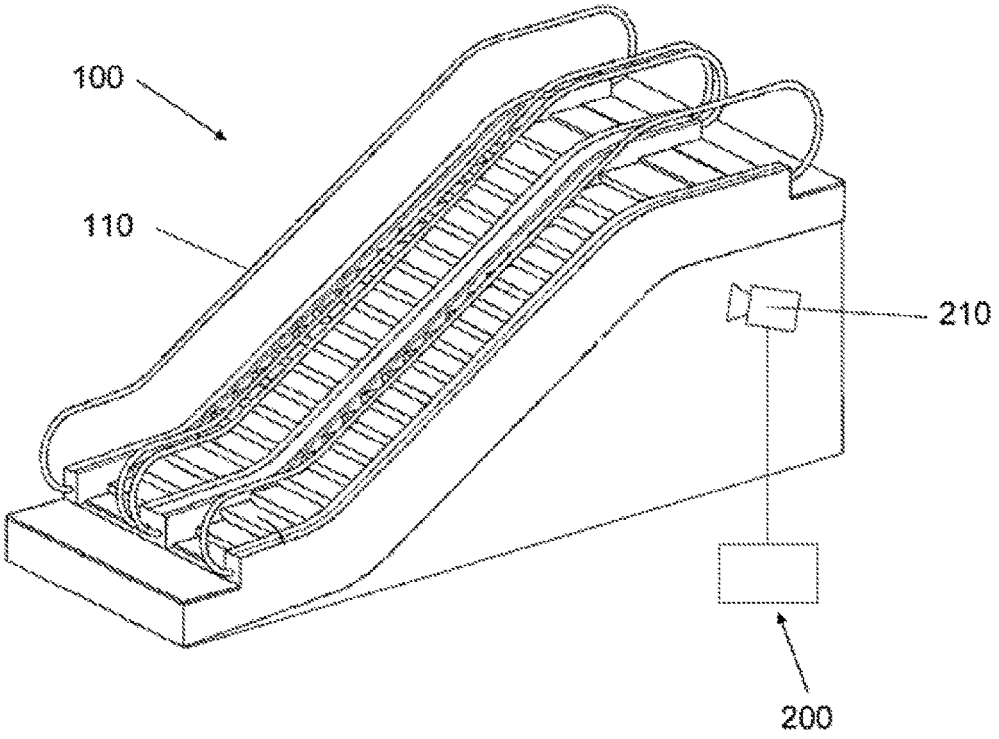
FIG. 1 is a schematic diagram of an embodiment of a passenger conveying device according to the present invention.

FIG. 1 illustrates a passenger conveying device and a moving handrail monitoring system thereof. The moving handrail monitoring system includes: an imaging sensor and/or a depth sensing sensor, and a processing device. The processing device is configured to include: a target object recognition module, an object feature extraction module, and a judgment module, so that a tension degree of a moving handrail of the passenger conveying device can be monitored in real time, to provide necessary alarm or maintenance, thereby avoiding danger when a passenger takes the passenger conveying device or a decrease in the apparatus life.

Specifically, a sensor required for sensing data should include at least an imaging sensor and/or a depth sensing sensor, and monitored data frames are acquired based on the imaging sensor and/or the depth sensing sensor. To achieve the objective of the present invention, it should be known that, in spite of the arrangement manner of the imaging sensor and/or the depth sensing sensor, the data frame acquired thereby should include at least part of the moving handrail.

The imaging sensors may be various types of 2D image sensors. It should be understood that any image sensor capable of capturing an image frame including pixel grayscale information may be applied herein. Definitely, image sensors capable of capturing an image frame including pixel grayscale information and color information (such as RGB information) may also be applied herein.

The depth sensing sensor may be any 1D, 2D or 3D depth sensor or a combination thereof. Such a sensor is operable in an optical, electromagnetic or acoustic spectrum capable of producing a depth map (also known as a point cloud or occupancy grid) with a corresponding dimension. Various depth sensing sensor technologies and devices include, but are not limited to, structured light measurement, phase shift measurement, time-of-flight measurement, a stereo triangulation device, an optical triangulation device plate, a light field camera, a coded aperture camera, a computational imaging technology, simultaneous localization and map-building (SLAM), an imaging radar, an imaging sonar, a scanning LIDAR, a flash LIDAR, a passive infrared (PIR) sensor, and a small focal plane array (FPA), or a combination including at least one of the foregoing. Different technologies may include active (transmitting and receiving a signal) or passive (only receiving a signal) technologies and are operable in a band of the electromagnetic or acoustic spectrum (such as visual and infrared, and the like). The use of depth sensing may achieve particular advantages over conventional 2D imaging. The use of infrared sensing may achieve particular benefits over visible spectrum imaging such that alternatively or additionally, the sensor can be an infrared sensor with one or more pixel spatial resolutions, e.g., a passive infrared (PIR) sensor or a small IR focal plane array (FPA).

It should be noted that there may be qualitative and quantitative differences between a 2D imaging sensor (e.g., a conventional security camera) and the 1D, 2D, or 3D depth sensing sensor in the extent that the depth sensing provides numerous advantages. In 2D imaging, a reflected color (a mixture of wavelengths) from the first object in each radial direction of the imager is captured. A 2D image, then, may include a combined spectrum of source lighting and a spectral reflectivity of an object in a scene. The 2D image may be interpreted by a person as a picture. In the 1D, 2D, or 3D depth-sensing sensor, there is no color (spectrum) information; more specifically, a distance (depth, range) to a first reflection object in a radial direction (1D) or directions (2D, 3D) from the sensor is captured. The 1D, 2D, and 3D technologies may have inherent maximum detectable range limits and may have relatively lower spatial resolution than typical 2D imagers. The use of 1D, 2D, or 3D depth sensing may advantageously provide improved operations, better separation of shielded objects, and better privacy protection compared to conventional 2D imaging in their relative immunity to ambient lighting problems. The use of infrared sensing may achieve particular benefits over visible spectrum imaging. For example, it is possible that a 2D image cannot be converted into a depth map and a depth map does not have a capability of being converted into a 2D image (for example, artificial allocation of continuous colors or grayscales to continuous depths may cause a person to roughly interpret a depth map in a manner somewhat akin to how a person sees a 2D image, while the depth map is not an image in a conventional sense).

In addition, the recognition module recognizes, based on a sensed movement and/or position and/or color and/or shape, a moving handrail portion that serves as a target object from the data frame. As an example, the recognition module may recognize the moving handrail based on the color of the moving handrail that is different from colors of other components on the passenger conveying device. As another example, the recognition module may also recognize the moving handrail based on the shape of the moving handrail that is different from shapes of other components on the passenger conveying device. The recognition module may further recognize the moving handrail based on the movement manner, moving speed and/or component position different from those of other components on the passenger conveying device.

In addition, the object feature extraction module is configured to extract a tension degree feature of the moving handrail portion. The tension degree features extracted here play an important role in the subsequent judgment on the tension degree of the moving handrail, which will be discussed in detail below.

Further, the judgment module is configured to compare the extracted tension degree feature with a system preset interval, and judge whether a current tension degree of the moving handrail is normal. Further actions may be taken according to the comparison result obtained here, to prevent further changes in the tension degree of the moving handrail and problems of the passenger safety or apparatus life that may be caused by the changes in the tension degree.

The moving handrail monitoring system for a passenger conveying device according to this embodiment can detect the problem of excessive changes in the tension degree of the moving handrail at an early time, and recover the moving handrail from the over-loose or over-tense state to a normal state at an early time, thus helping avoid accidents, improve safety of passengers, and prolong the service life of the handrail strap.

The foregoing embodiment further has several improvements or modifications, and some of the modifications are selected to describe below.

For example, as an example, the moving handrail monitoring system for a passenger conveying device may further include an execution module, which may send an alarm to a monitoring center and/or maintenance personnel based on the judgment of whether the current tension degree is normal made by the judgment module. Then, the maintenance personnel can timely go to the site to carry out maintenance and repair. If the maintenance personnel cannot go to the site in time, the monitoring center may even directly shut down the passenger conveying device temporarily, to avoid safety problems.

Further, as an example, the tension degree feature may include: a shape feature of the moving handrail and/or a position feature of the moving handrail and/or a curvature feature of the moving handrail; and/or the system preset interval includes: a shape preset interval of the moving handrail and/or a position preset interval of the moving handrail and/or a curvature preset interval of the moving handrail. A change in the tension degree may correspondingly cause the shape, position, or curvature of the moving handrail to change. Therefore, correspondingly, by comparing the change in the shape, position, curvature, or any combination thereof of the moving handrail with the corresponding system preset interval, whether the tension degree of the moving handrail is normal can be accurately and effectively reflected.

For another example, the monitoring system may further include a temperature sensor and/or a speed sensor, and the tension degree feature further includes a temperature feature of the moving handrail and/or a speed feature of the moving handrail. The two features can also reflect and be reflected by the tension degree of the moving handrail. For example, when the moving handrail is in an over-tense state in a long run, the temperature of the moving handrail will rise. For another example, when the moving handrail is in an over-loose state in a long run, the speed of the moving handrail will be different from the speed of the step, and is faster or slower than the speed of the step.

It should be noted that, when the monitoring system includes multiple sensors, information from different sensors can be combined using a Bayesian Estimator, to improve precision. The Bayesian Estimator maximizes the posteriori probability (figure), and a point estimate of the tension degree of the handrail is obtained by using all available data.

Figure 2:
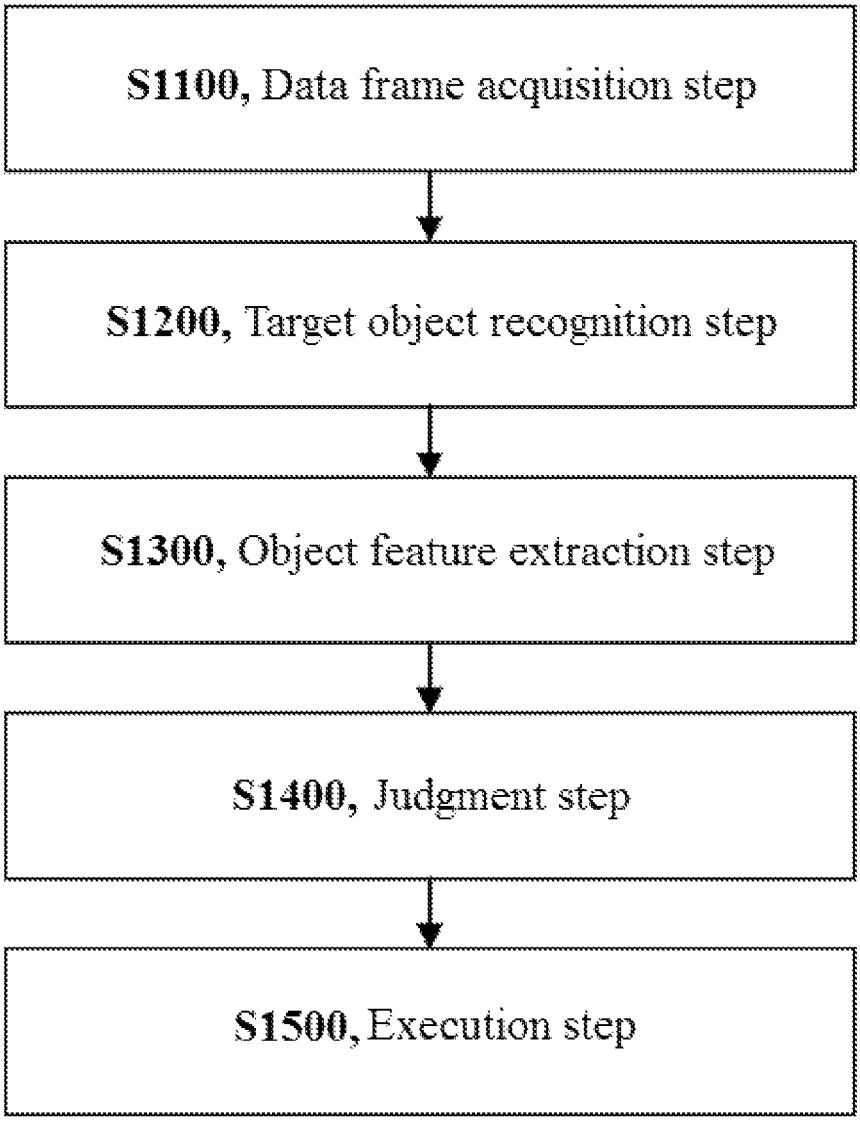
FIG. 2 is a schematic diagram of steps in an embodiment of a moving handrail monitoring method of a passenger conveying device according to the present invention.
Figure 3:
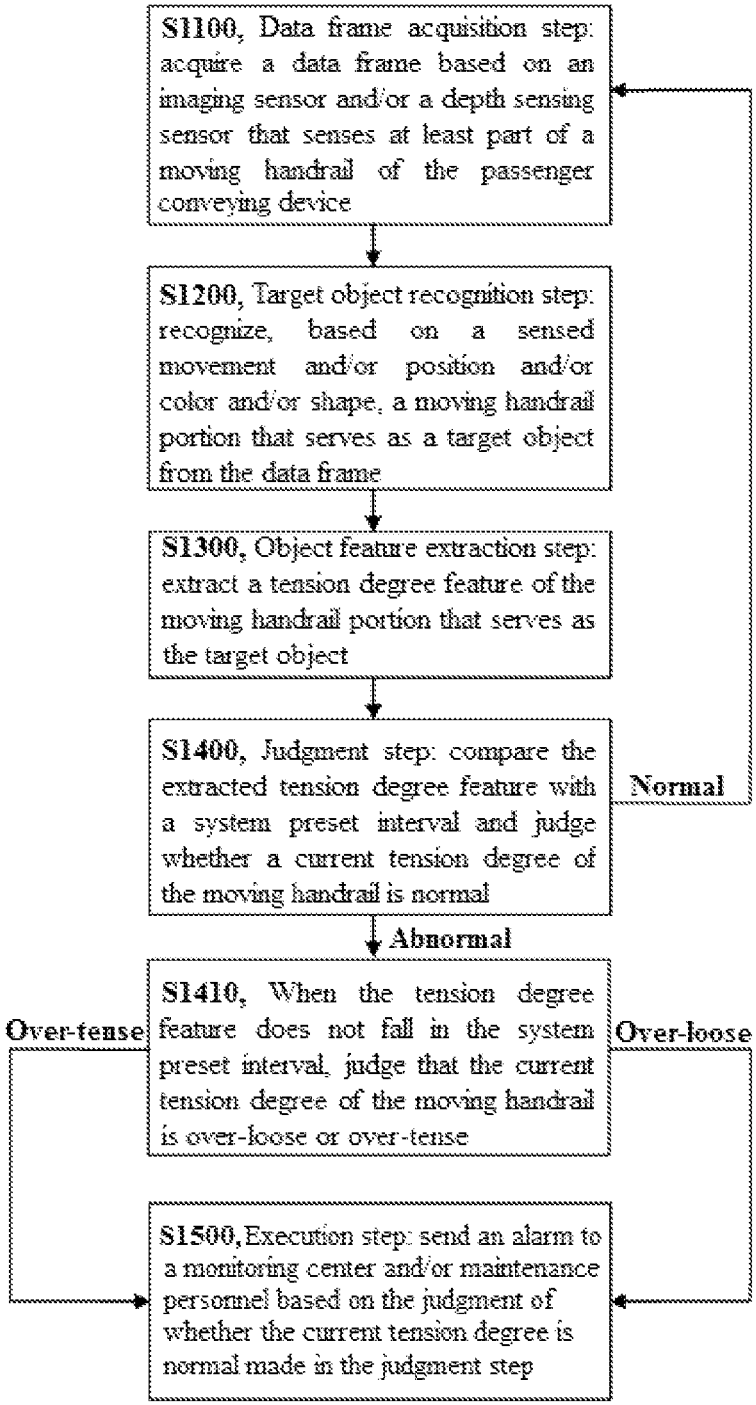
FIG. 3 is a control flowchart of an embodiment of a moving handrail monitoring method of a passenger conveying device according to the present invention.

In addition, referring to FIG. 2 and FIG. 3, a moving handrail monitoring method of a passenger conveying device is further provided, to cooperate with the moving handrail monitoring system described in the foregoing embodiment for use. The monitoring method includes the following steps: S1100, a data frame acquisition step: acquiring a data frame based on an imaging sensor and/or a depth sensing sensor that sense/senses at least part of a moving handrail of the passenger conveying device; S1200, a target object recognition step: recognizing, based on a sensed movement and/or position and/or color and/or shape, a moving handrail portion that serves as a target object from the data frame; S1300, an object feature extraction step: extracting a tension degree feature of the moving handrail portion that serves as the target object; and S1400, a judgment step: comparing the extracted tension degree feature with a system preset interval and judging whether a current tension degree of the moving handrail is normal. This method can correctly and timely recognize various deformations of the moving handrail due to changes in the tension degree, and send an alarm so that the monitoring center or maintenance personnel can make a response in time.

In addition, in order to improve the practicability and accuracy of the monitoring method in the foregoing embodiment, several improvements or modifications for the steps therein are further provided.

Specifically, S1300 further includes: extracting a shape feature of the moving handrail; and/or extracting a position feature of the moving handrail; and/or extracting a curvature feature of the moving handrail. Correspondingly, S1400 further includes: comparing the shape feature of the moving handrail with a shape preset interval of the moving handrail; and/or comparing the position feature of the moving handrail with a position preset interval of the moving handrail; and/or comparing the curvature feature of the moving handrail with a curvature preset interval of the moving handrail. Because these features are easier to be visually detected by the imaging sensor and/or the depth sensing sensor, the features can be compared with the system preset intervals more precisely.

As another improvement example, S1300 further includes: extracting a temperature feature of the moving handrail; and/or extracting a speed feature of the moving handrail. Correspondingly, S1400 further includes: comparing the temperature feature of the moving handrail with a temperature preset interval of the moving handrail; and/or comparing the speed feature of the moving handrail with a speed preset interval of the moving handrail. An additional temperature sensor and an additional speed sensor need to be disposed to detect these features. These features are correlated with changes in the tension degree of the moving handrail, so that the state of the tension degree of the moving handrail can be detected more accurately.

As a specific judgment manner, S1400 further includes: when the tension degree feature falls in the system preset interval, the current tension degree of the moving handrail is normal; and when the tension degree feature does not fall in the system preset interval, the current tension degree of the moving handrail is abnormal. Further, the method further includes S1410: when the tension degree feature does not fall in the system preset interval, judging that the current tension degree of the moving handrail is over-loose or over-tense. This allows the monitoring center or maintenance personnel to know the current status of the moving handrail in further detail, thereby making a more proper response and operation.

Optionally, considering that in some cases, the moving handrail may have an exception such as being over-tense or over-loose transiently, and then may automatically recover to a normal state. In this case, the monitoring center does not need to make a shutdown operation, nor does the maintenance personnel need to go to the site for maintenance. Therefore, S1400 may be further improved, so that it further includes: when the tension degree feature falls in the system preset interval, the current tension degree of the moving handrail is normal; when a time during which the tension degree feature is not in the system preset interval is less than a first preset time period, the current tension degree of the moving handrail is normal; and when a time during which the tension degree feature is not in the system preset interval is greater than or equal to the first preset time period, the current tension degree of the moving handrail is abnormal.

In addition, after making the judgment of whether the tension degree of the moving handrail is normal, the method may further include: S1500, an execution step: sending an alarm to a monitoring center and/or maintenance personnel based on the judgment of whether the current tension degree is normal made in the judgment step, so that a corresponding mechanism can make a response to eliminate this anomaly.

Under the monitoring with the monitoring method of this embodiment, the abnormal tension state of the moving handrail can be detected at an early time, which is extremely important for fault detection of the moving handrail. If the tension of the handrail does not fall in the system preset interval, an anomaly signal will be triggered and an alarm will be sent. The alarm information may be directly sent to an elevator supplier management department, so that maintenance personnel can inspect and repair the fault in time. The alarm information may further be sent to a detection monitoring center and an escalator manager, which can carry out further estimation to make a response, for example, stopping the escalator and disposing barriers at the entry and exit of the escalator. Alternatively, if there is no passenger on the escalator, the escalator may be controlled to stop directly. This monitoring method is conducive to detecting and solving the anomaly at an early stage, thereby avoiding accidents, improving the safety of passengers, and prolonging the service life of the handrail.

According to the conception of the present invention, another embodiment of a moving handrail monitoring system for a passenger conveying device is further provided. It is similar to the foregoing embodiment of the monitoring system but the difference lies in that, this embodiment provides a reference background for assisting in judgment of the abnormal state of the tension degree. This monitoring system will be described in detail as follows.

Specifically, the moving handrail monitoring system includes: an imaging sensor and/or a depth sensing sensor configured to sense at least part of a moving handrail of the passenger conveying device to acquire a data frame. In order to achieve the objective of the present invention, it should be known that, in spite of the arrangement manner of the imaging sensor and/or the depth sensing sensor, the data frame acquired thereby should include at least part of the moving handrail.

In addition, the moving handrail monitoring system further includes a target object recognition module, which recognizes, based on a sensed movement and/or position and/or color and/or shape, a moving handrail portion that serves as a target object from the data frame. As an example, the target object recognition module may recognize the moving handrail based on the color of the moving handrail that is different from colors of other components on the passenger conveying device. As another example, the target object recognition module may also recognize the moving handrail based on the shape of the moving handrail that is different from shapes of other components on the passenger conveying device. The target object recognition module may further recognize the moving handrail based on the movement manner, moving speed and/or component position different from those of other components on the passenger conveying device.

In addition, the moving handrail monitoring system further includes a reference background that includes a normal zone and an abnormal zone. The reference background is briefly partitioned, and provides mapping for the moving handrail portion that serves as the target object, so that the tension degree status of the moving handrail can be presented conveniently and quickly. For example, the reference background may be a screen presenting different colors. When the moving handrail falls in a green screen interval, the tension degree of the moving handrail can be considered as normal; when the moving handrail falls in a red screen interval, the tension degree of the moving handrail can be considered as over-tense; when the moving handrail falls in a yellow screen interval, the tension degree of the moving handrail can be considered as over-loose.

Finally, the moving handrail monitoring system further includes a judgment module, which judges whether a current tension degree of the moving handrail is normal based on whether the moving handrail portion that serves as the target object falls in the normal zone and/or abnormal zone of the reference background. Specifically, when the moving handrail portion that serves as the target object falls in the normal zone of the reference background, the current tension degree of the moving handrail is normal; and/or when the moving handrail portion that serves as the target object falls in the abnormal zone of the reference background, the current tension degree of the moving handrail is abnormal; and/or when the moving handrail portion that serves as the target object falls in the normal zone and the abnormal zone of the reference background at the same time, the current tension degree of the moving handrail is abnormal. Further actions may be taken according to the comparison result obtained here, to prevent further changes in the tension degree of the moving handrail and problems of the passenger safety or apparatus life that may be caused by the changes in the tension degree.

The moving handrail monitoring system for a passenger conveying device according to this embodiment can detect the problem of excessive changes in the tension degree of the moving handrail at an early time, and recover the moving handrail from the over-loose or over-tense state to a normal state at an early time, thus helping avoid accidents, improve safety of passengers, and prolong the service life of the handrail.

The foregoing embodiment further has several improvements or modifications, and some of the modifications are selected to describe below.

For example, as an example, the moving handrail monitoring system for a passenger conveying device may further includes an execution module, which sends an alarm to a monitoring center and/or maintenance personnel based on the judgment of whether the current tension degree is normal made by the judgment module. Then, the maintenance personnel can timely go to the site to carry out maintenance and repair. If the maintenance personnel cannot go to the site in time, the monitoring center may even directly shut down the passenger conveying device temporarily, to avoid safety problems.

For another example, as a further refined example, the abnormal zone includes an over-loose zone and an over-tense zone. The judgment module is configured to compare the moving handrail portion with the reference background: when the moving handrail portion falls in the over-loose zone of the reference background, the current tension degree of the moving handrail is over-loose; and/or when the moving handrail portion falls in the over-tense zone of the reference background, the current tension degree of the moving handrail is over-tense.

Based on the moving handrail monitoring system for a passenger conveying device in any of the foregoing embodiments, an embodiment of the passenger conveying device is further provided here. Referring to FIG. 1, this embodiment not only includes the corresponding arrangement about the moving handrail monitoring system for a passenger conveying device in any of the foregoing embodiments, but also further improves the arrangement manner of the imaging sensor and/or the depth sensing sensor therein.

For example, as an example, the imaging sensor and/or the depth sensing sensor are/is arranged inside the passenger conveying device. This is because the tension degree status of the moving handrail can be detected more conveniently and clearly inside the passenger conveying device. For example, when the moving handrail is over-loose, it can be detected clearly that a part of the moving handrail inside the passenger conveying device presents an excessively saggy arc; when the moving handrail is over-tense, it can be detected clearly that a part of the moving handrail inside the passenger conveying device presents an almost straight state.

More specifically, the imaging sensor and/or the depth sensing sensor are/is arranged on a side portion of the moving handrail. Because changes of the moving handrail mainly occur in the vertical direction, the changes in the shape, position or curvature thereof can be better detected from the lateral side.

The passenger conveying device of this embodiment has many application variations in daily life. For example, the passenger conveying device may include an escalator and a moving walk.

Figure 4:
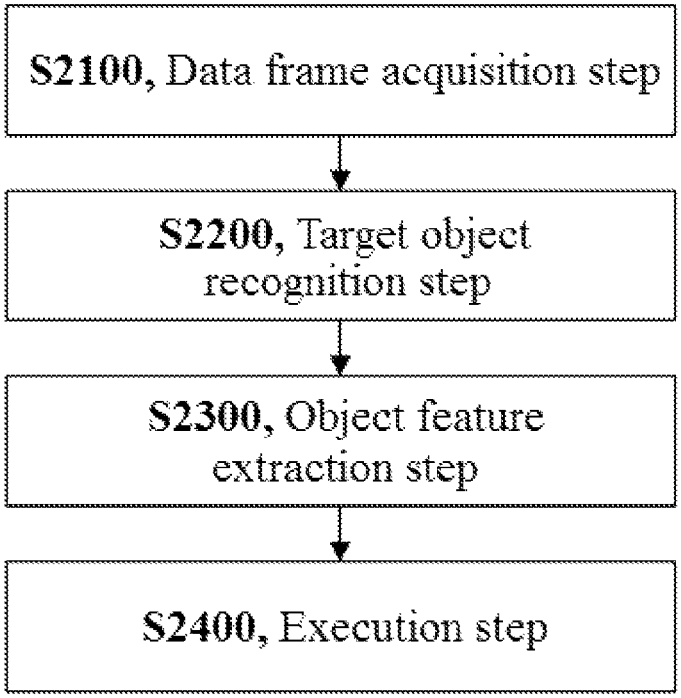
FIG. 4 is a schematic diagram of steps in another embodiment of a moving handrail monitoring method of a passenger conveying device according to the present invention.
Figure 5:
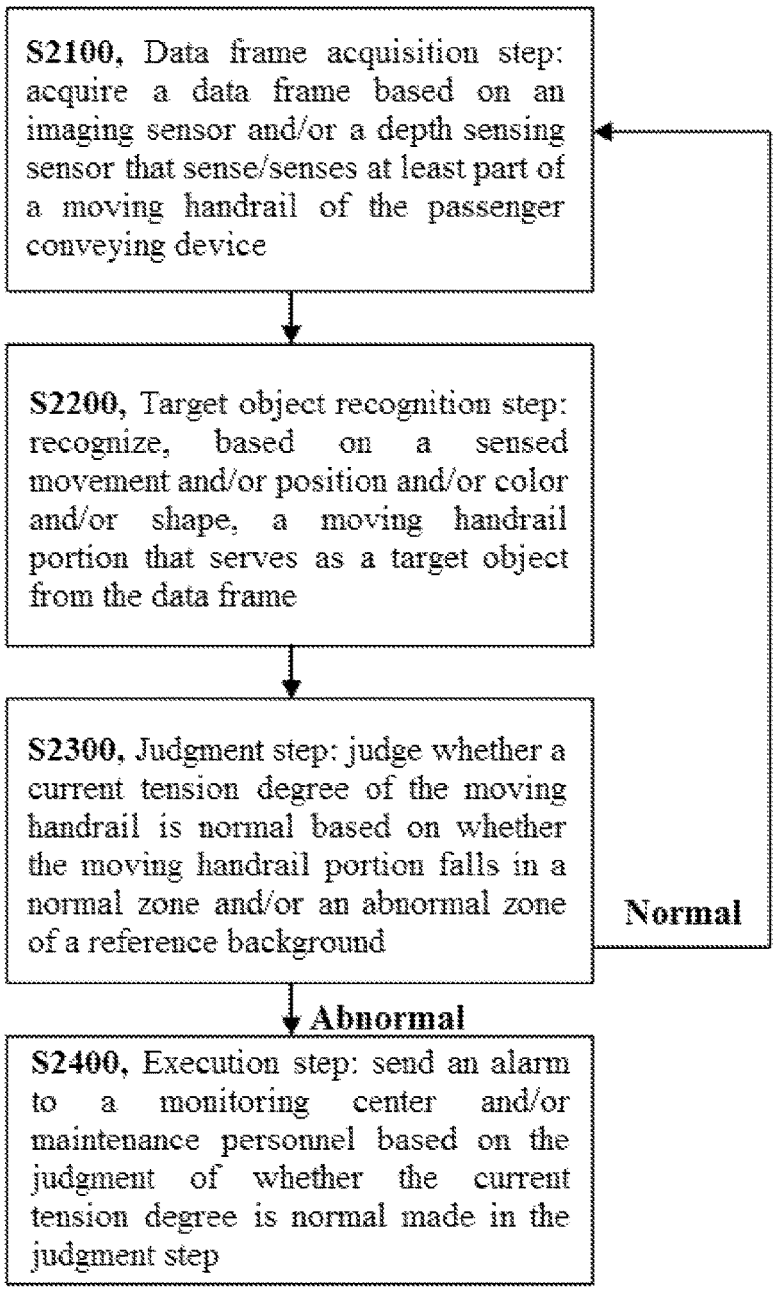
FIG. 5 is a control flowchart of another embodiment of a moving handrail monitoring method of a passenger conveying device according to the present invention.

In addition, referring to FIG. 4 and FIG. 5, a moving handrail monitoring method of a passenger conveying device is further provided here, to cooperate with the moving handrail monitoring system described in the foregoing embodiment for use. The monitoring method includes the following steps: S2100, a data frame acquisition step: acquiring, based on an imaging sensor and/or a depth sensing sensor, a data frame including a moving handrail; S2200, a target object recognition step: recognizing, based on a sensed movement and/or position and/or color and/or shape, a moving handrail portion that serves as a target object from the data frame; S2300, a judgment step: judging whether a current tension degree of the moving handrail is normal based on whether the moving handrail portion that serves as the target object falls in a normal zone and/or an abnormal zone of a reference background. This method can correctly and timely recognize various deformations of the moving handrail due to changes in the tension degree, and send an alarm so that the monitoring center or maintenance personnel can make a response in time.

In addition, in order to improve the practicability and accuracy of the monitoring method in the foregoing embodiment, several improvements or modifications for the steps therein are further provided.

As a specific judgment manner, S2300 further includes: when the moving handrail portion falls in the normal zone of the reference background, the current tension degree of the moving handrail is normal; and/or when the moving handrail portion falls in the abnormal zone of the reference background, the current tension degree of the moving handrail is abnormal; and/or when the moving handrail portion falls in the normal zone and the abnormal zone of the reference background at the same time, the current tension degree of the moving handrail is abnormal. Further, the abnormal zone includes an over-loose zone and an over-tense zone: when the moving handrail portion falls in the over-loose zone of the reference background, the current tension degree of the moving handrail is over-loose; and/or when the moving handrail portion falls in the over-tense zone of the reference background, the current tension degree of the moving handrail is over-tense. In this way, the anomaly forms are further subdivided, so that the monitoring center or maintenance personnel can be informed at an early time, thus making a more accurate and reliable processing solution.

Optionally, considering that in some cases, the moving handrail may have an exception such as being over-tense or over-loose transiently, and then may automatically recover to a normal state. In this case, the monitoring center does not need to make a shutdown operation, nor does the maintenance personnel need to go to the site for maintenance. Therefore, S2300 may be further improved, so that it further includes: when the moving handrail portion falls in the normal zone of the reference background, the current tension degree of the moving handrail is normal; and/or when a time during which the moving handrail portion is in the abnormal zone of the reference background is less than a second preset time period, the current tension degree of the moving handrail is normal; and/or when a time during which the moving handrail portion is in the abnormal zone of the reference background is greater than the second preset time period, the current tension degree of the moving handrail is abnormal.

In addition, after making the judgment of whether the tension degree of the moving handrail is normal, the method may further include: S2400, an execution step: sending an alarm to a monitoring center and/or maintenance personnel based on the judgment of whether the current tension degree is normal made in the judgment step, so that a corresponding mechanism can make a response to eliminate this anomaly.

Under the monitoring with the monitoring method of this embodiment, the abnormal tension state of the moving handrail can be detected at an early time, which is extremely important for fault detection of the moving handrail. If the tension of the handrail does not fall in the system preset interval, an anomaly signal will be triggered and an alarm will be sent. The alarm information may be directly sent to an elevator supplier management department, so that maintenance personnel can inspect and repair the fault in time. The alarm information may further be sent to a detection monitoring center and an escalator manager, which can carry out further estimation to make a response, for example, stopping the escalator and disposing barriers at the entry and exit of the escalator. Alternatively, if there is no passenger on the escalator, the escalator may be controlled to stop directly. This monitoring method is conducive to detecting and solving the anomaly at an early stage, thereby avoiding accidents, improving the safety of passengers, and prolonging the service life of the handrail.

It should be noted that, herein, the shape feature (descriptor) may be calculated through a technology such as histogram of oriented gradients (HoG), Zernike moment, Centroid Invariance to boundary point distribution, or Contour Curvature. Other features may be extracted to provide additional information for shape (or morphological) matching or filtering. For example, the other features may include, but are not limited to, Scale Invariant Feature Transform (SIFT), a Speed-Up Robust Feature (SURF) algorithm, Affine Scale Invariant Feature Transform (ASIFT), other SIFT variables, Harris Corner Detector, a Smallest Univalue Segment Assimilating Nucleus (SUSAN) algorithm, Features from Accelerated Segment Test (FAST) corner detection, Phase Correlation, Normalized Cross-Correlation, a Gradient Location Orientation Histogram (GLOH) algorithm, a Binary Robust Independent Elementary Features (BRIEF) algorithm, a Center Surround Extremas (CenSure/STAR) algorithm, an Oriented and Rotated BRIEF (ORB) algorithm and other features. The shape feature may be compared or classified as a shape, wherein one or more of the following technologies are used: clustering, Deep Learning, Convolutional Neural Networks, Recursive Neural Networks, Dictionary Learning, a Bag of visual words, a Support Vector Machine (SVM), Decision Trees, Fuzzy Logic, and so on.

It should be noted that the elements disclosed and depicted herein (including flowcharts and block diagrams in the accompanying drawings) imply logical boundaries between the elements. However, according to software or hardware engineering practices, the depicted elements and the functions thereof may be implemented on machines through a computer executable medium. The computer executable medium has a processor capable of executing program instructions stored thereon as a monolithic software structure, as standalone software modules, or as modules that employ external routines, code, services, and so forth, or any combination thereof, and all such implementations may fall within the scope of the present disclosure.

Although the different non-limiting implementation solutions have specifically illustrated assemblies, the implementation solutions of the present invention are not limited to those particular combinations. It is possible to use some of the assemblies or features from any of the non-limiting implementation solutions in combination with features or assemblies from any other non-limiting implementation solutions.

Although particular step sequences are shown, disclosed, and claimed, it should be appreciated that the steps may be performed in any order, separated or combined, unless otherwise indicated and will still benefit from the present disclosure.

The foregoing description is exemplary rather than defined by the limitations within. Various non-limiting implementation solutions are disclosed herein, however, persons of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason, the appended claims should be studied to determine the true scope and content.

What is claimed is:

1. A moving handrail monitoring method of a passenger conveying device, comprising:

a data frame acquisition step: acquiring a data frame based on an imaging sensor and/or a depth sensing sensor that sense/senses at least part of a moving handrail of the passenger conveying device, the imaging sensor and/or depth sensor being spaced from the moving handrail;

a target object recognition step: recognizing, based on a sensed movement and/or position and/or color and/or shape, a moving handrail portion that serves as a target object from the data frame; and a judgment step: judging whether a current tension degree of the moving handrail is normal based on whether the moving handrail portion falls in a normal zone and/or an abnormal zone of a reference background.

2. The monitoring method according to claim 1, wherein further comprises:

when the moving handrail portion falls in the normal zone of the reference background, the current tension degree of the moving handrail is normal; and/or when the moving handrail portion falls in the abnormal zone of the reference background, the current tension degree of the moving handrail is abnormal; and/or when the moving handrail portion falls in the normal zone and the abnormal zone of the reference background at the same time, the current tension degree of the moving handrail is abnormal.

3. The monitoring method according to claim 2, wherein the abnormal zone comprises an over-loose zone and an over-tense zone: when the moving handrail portion falls in the over-loose zone of the reference background, the current tension degree of the moving handrail is over-loose; and/or when the moving handrail portion falls in the over-tense zone of the reference background, the current tension degree of the moving handrail is over-tense.

4. The monitoring method according to claim 1, wherein further comprises:

when the moving handrail portion falls in the normal zone of the reference background, the current tension degree of the moving handrail is normal; and/or when a time during which the moving handrail portion is in the abnormal zone of the reference background is less than a second preset time period, the current tension degree of the moving handrail is normal; and/or when a time during which the moving handrail portion is in the abnormal zone of the reference background is greater than the second preset time period, the current tension degree of the moving handrail is abnormal.

5. The monitoring method according to claim 1, further comprising:

an execution step: sending an alarm to a monitoring center and/or maintenance personnel based on the judgment of whether the current tension degree is normal made in the judgment step.

* * * * *